United States Patent [19]

Hinshaw

[11] Patent Number: 4,621,462

[45] Date of Patent: Nov. 11, 1986

[54] DUST COLLECTION APPARATUS

[75] Inventor: Robert L. Hinshaw, Seattle, Wash.

[73] Assignee: The Boeing Company, Seattle, Wash.

[21] Appl. No.: 773,305

[22] Filed: Sep. 6, 1985

[51] Int. Cl.[4] ..... B24B 55/06

[52] U.S. Cl. ..... 51/273

[58] Field of Search ..... 51/273, 268; 144/252 R; 408/67; 29/DIG. 84

[56] References Cited

U.S. PATENT DOCUMENTS

| | | | |
|---|---|---|---|
| 1,623,520 | 4/1927 | Bennington . | |
| 1,938,330 | 12/1933 | Hall . | |
| 2,219,444 | 10/1940 | Eserkaln et al. . | |
| 2,527,968 | 10/1950 | Sherman et al. . | |
| 2,879,530 | 3/1959 | Ego . | |
| 2,954,653 | 10/1960 | Harvey . | |
| 3,594,958 | 7/1971 | Cusumano | 51/273 |
| 3,786,846 | 1/1974 | Mehring | 51/273 |
| 3,862,521 | 1/1975 | Isaksson | 51/273 |
| 3,882,644 | 5/1975 | Cusumano | 51/273 |
| 3,935,678 | 2/1976 | Marton | 51/273 |
| 4,037,982 | 7/1977 | Clement | 51/273 |
| 4,051,880 | 10/1977 | Hestily | 51/273 |
| 4,184,226 | 1/1980 | Loevenich | 408/67 |
| 4,200,417 | 4/1980 | Hager et al. | 51/273 |
| 4,245,437 | 1/1981 | Marton | 51/273 |
| 4,328,645 | 5/1982 | Sauer | 51/273 |
| 4,409,699 | 10/1983 | Moorhouse | 51/273 |

FOREIGN PATENT DOCUMENTS

| | | | |
|---|---|---|---|
| 2261297 | 6/1974 | Fed. Rep. of Germany | 51/273 |
| 848841 | 9/1960 | United Kingdom | 51/273 |

*Primary Examiner*—Roscoe V. Parker

*Attorney, Agent, or Firm*—Christensen, O'Connor, Johnson & Kindness

[57] ABSTRACT

Disclosed is a dust collecting apparatus (10) that is attachable to a machine tool (12) to remove dust created during the tool's operation. The dust collection apparatus includes a cylindrical sleeve (24) mounted on the body (14) of the machine tool and extending outwardly over the spindle (16) of the tool to a point near the tool's cutter (20). A cylindrical shroud (34) is fastened to and surrounds the sleeve (24) and creates a chamber (44) between the sleeve and the shroud. Duct tubes (48) attached to the shroud connect the chamber and a vacuum source. The applied vacuum creates suction in the chamber which has its inlet end (46) located near the cutter of the machine tool. A restrictor ring (50) attached to sleeve (24) at the inlet end of the chamber minimizes the cross-sectional area of that portion of the chamber to create a high velocity airstream very near to the point at which the dust particles are produced. The airstream deflects the dust particles into the chamber. The dust particles leave the chamber via the duct tubes (48).

12 Claims, 5 Drawing Figures

DUST COLLECTION APPARATUS

TECHNICAL BACKGROUND

This invention pertains to the control of dust produced when a workpiece is machined and, more particularly, to an apparatus attachable to a machine tool for collection of the dust near the point where the dust is produced.

BACKGROUND OF THE INVENTION

Conventional power-driven machine tools are used for shaping, cutting, drilling, grinding or polishing workpieces. The tools generally include rotary cutters with abrasive ends that, when applied to the workpiece, produce dust particles. When such tools are used to shape workpieces formed of composite material, such as graphite fibers embedded within a resin matrix, the produced dust is quite noxious. The dust created from machining composite material is especially troublesome since its relatively low density (when compared to metal) results in wide-ranging dispersion of the dust throughout the worksite.

The dust particles created by the rotary cutters of the machine tools are propelled with high velocity away from the workpiece in all directions as the cutter is moved around the various parts of the workpiece. In order to protect the worker and machinery from the harmful effects of the dust, it is necessary to control the dust to prevent its general dispersion around the worksite.

One common method of dust control is to apply suction devices near the workpiece in order to direct the dust to a suitable disposal point. For effective removal of the dust particles it is necessary to develop, by way of the suction device, a stream of air moving with relatively high velocity with respect to the velocity of the dust particles and to direct that stream across the path of the dust particles. For most effective redirection of the dust particles, this high velocity airstream must be created very near the point of dust production. Furthermore, since the direction in which the dust particles are propelled varies as the cutter is moved around the workpiece, the stream of air developed by the suction device should be capable of intercepting the dust particles regardless of the direction in which they are propelled.

SUMMARY OF THE INVENTION

In accordance with this invention a dust collection apparatus is provided for attachment to a machine tool that includes a body and a rotatable spindle attached to the body and projecting therefrom. The machine tool also includes an abrasive cutter fixed to the outermost end of the spindle. The dust collection apparatus comprises a hollow sleeve having an inner end and an outer end. The inner end of the sleeve fits over and attaches to the body of the machine tool so that the cutter projects outwardly through the outer end of the sleeve. The dust collection apparatus also includes a hollow shroud having a cross-sectional area larger than the sleeve. The hollow shroud is connected to the sleeve and positioned to surround the sleeve. The shroud has an inner end and an outer end corresponding to the inner end and outer end, respectively, of the sleeve, the shroud being configured and arranged to define a chamber between the sleeve and the shroud. The chamber extends substantially around the periphery of the sleeve. The chamber has an inlet end defined between the outer end of the sleeve and the outer end of the shroud. One or more suction tubes are connected to the shroud for creating a vacuum in the chamber. Also provided is a restrictor element connected to the outer end of the sleeve and positioned in the chamber to minimize the cross-sectional area of the chamber at the inlet end thereof so that the velocity of air drawn into the chamber is highest near the point of dust production.

In accordance with another aspect of this invention the inlet end of the chamber extends continuously around the cutter thereby providing suction force to direct the dust particles into the chamber regardless of the direction in which the dust particles are initially propelled by the machine tool.

In accordance with a further aspect of this invention a flange is attached to the outer end of the shroud. The flange projects substantially radially outwardly with respect to the rotational axis of the spindle and provides a partial obstruction around the inlet end of the chamber to direct air entering the high velocity airstream from alongside the shroud across the path of the dust particles.

In accordance with further aspects of this invention a resilient barrier element is affixed to the outer end of the shroud and extends outwardly to substantially surround the outermost end of the cutter. The barrier element stops heavier dust particles that would otherwise be projected past the inlet end of the chamber. After impinging upon the barrier element, the heavier dust particles are drawn into the chamber.

BRIEF DESCRIPTION OF THE DRAWINGS

The invention with its attendant advantages will become better understood from the following detailed descripton when considered in combination with the accompanying drawings, wherein.

DETAILED DESCRIPTION OF THE PREFERRED EMBODIMENT

Figure 1:
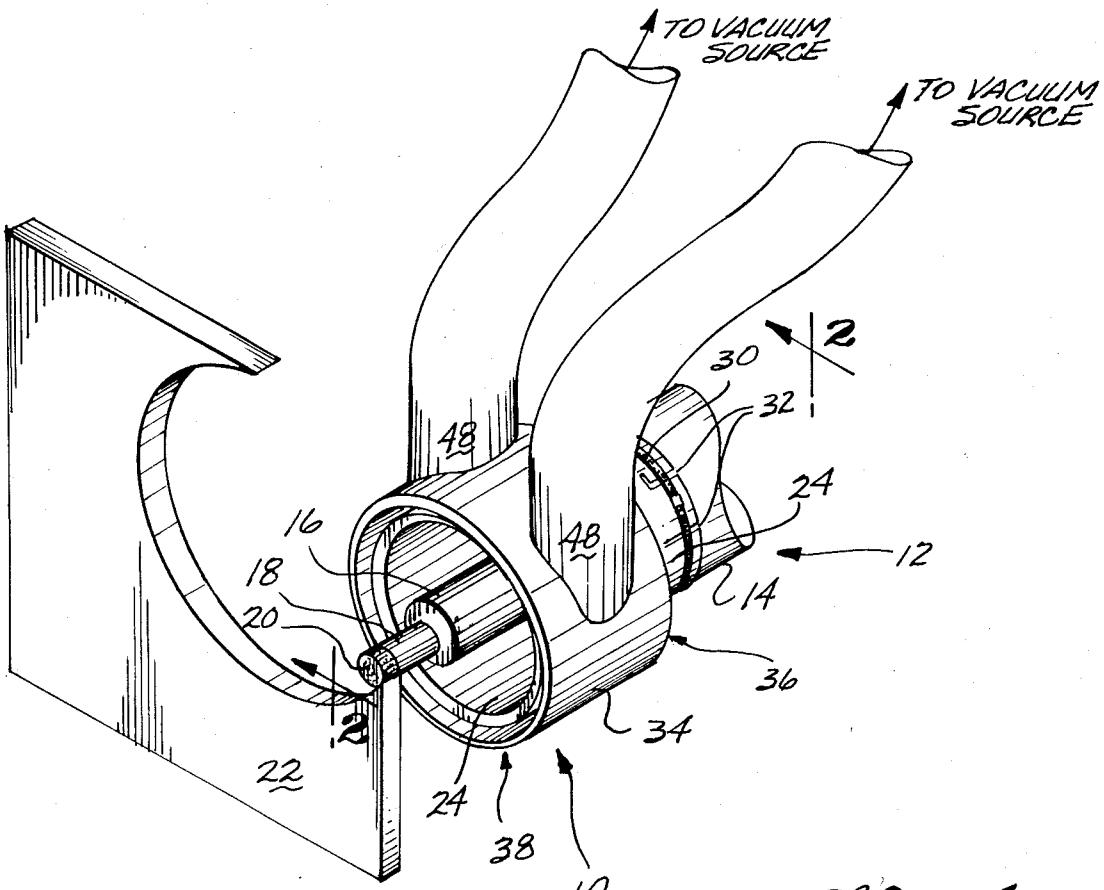
FIG. 1 is an isometric view of a dust collecting apparatus formed in accordance with this invention mounted on a conventional machine tool.

Shown in FIG. 1 is a dust collection apparatus 10 formed in accordance with this invention attached to a machine tool 12. The machine tool 12 includes a substantially cylindrically-shaped body 14 that is provided with suitable mechanisms for rotating an attached spindle 16 at very high speeds. A cutter 18 is attached to the outermost end of the spindle 16 and includes an abrasive portion 20 formed in its outermost end. Such machine tools are well known in the art and comprise no part of this invention.

When the rotating cutter is brought into contact with a workpiece 22, the contacted portion of the workpiece is disintegrated into dust particles. The workpiece is typically formd of metal or composite material such as graphite fibers embedded within a resin matrix. When the latter material is cut the dust particles produced are most troublesome since they are relatively low in density and easily suspended and dispersed in the air surrounding the workpiece. The dust collecting apparatus formed in accordance with this invention is directed to the efficient removal of these dust particles from the worksite.

Figure 2:
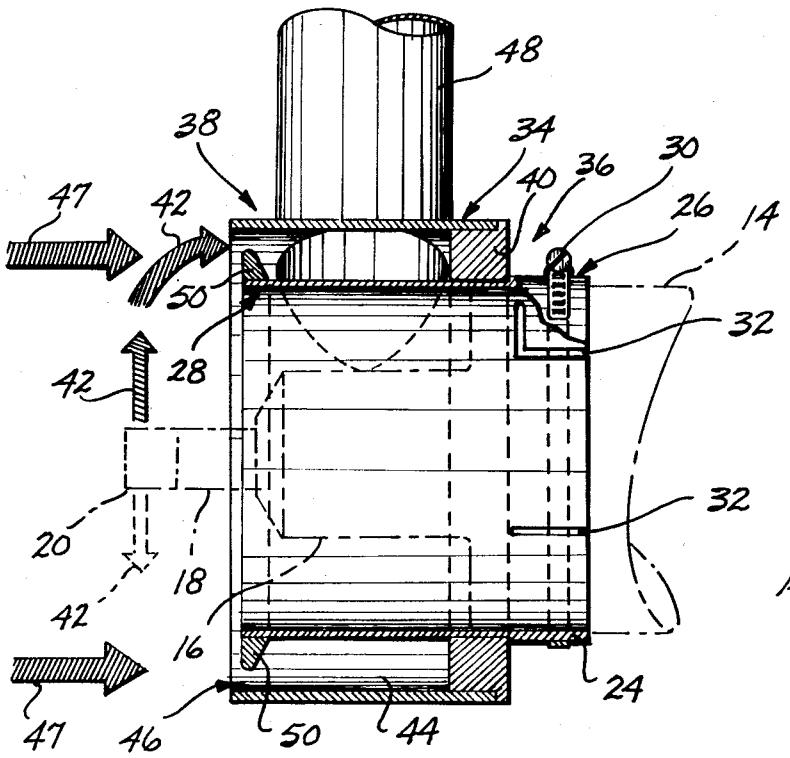
FIG. 2 is a cross-sectional view of the apparatus in FIG. 1 taken along line 2—2.

Referring to FIGS. 1 and 2, the preferred embodiment of the invention particularly comprises a cylindrical sleeve 24 having an inner end 26 and an outer end 28. The sleeve 24 is formed with an inside diameter approximately equal to the outside diameter of the machine tool body 14. The inner end 26 of the sleeve 24 fits over the body 14 and is secured thereto by any suitable means such as a hose clamp 30 which wraps around the circumference of the inner end of the sleeve. A plurality of slots 32 are formed in the inner end of the sleeve 24. The slots 32 allow the inner end of the sleeve to flex inwardly to secure the sleeve to the machine tool body 14 when the clamp 30 is tightened. As shown in the Figures, the outermost portion of the cutter 18 projects outwardly through the outer end 28 of the sleeve 24 when the sleeve is fastened to the machine tool.

A hollow cylindrical shroud 34 having a diameter greater than that of the sleeve 24 is positioned to surround the sleeve. The shroud 34 has an inner end 36 and an outer end 38 corresponding to the inner end 26 and the outer end 28 of the sleeve 24. The shroud 34 has an annulus 40 fixed to its inside wall at its inner end 36. The annulus 40 is fastened along its innermost surface around the periphery of sleeve 24 near the inner end 26 thereof.

As a result of the foregoing structural arrangement, a chamber 44 is formed between the shroud 34 and the surrounded portion of the sleeve 24. The chamber 44 includes an inlet end 46 defined between the outer end 28 of the sleeve 24 and the outer end 38 of the shroud 34. Two tubular ducts 48 are connected to the shroud and provide communication between the chamber 44 and a conventional vacuum source (not shown). When suction is applied to the chamber 44 via the tubular ducts 48, a stream of air, represented by arrows 47, is drawn into the inlet end of the chamber and outwardly through the ducts 48. As shown in FIG. 2, dust particles, represented by arrow 42, are propelled radially outwardly from the abrasive end 20 of the cutter 18 as the cutter contacts the workpiece. The dust particles are intercepted by the dust collector airstream 47 and redirected to the chamber 44 and outwardly through the ducts 48.

In order to achieve maximum dust collection, the highest airstream velocity should occur at or very near the point where the dust particles are produced. The invention achieves this result by attaching a restrictor ring 50 to the outer end 28 of the sleeve 24 such that the restrictor ring projects radially outwardly from the outer wall of the sleeve. The effect of restrictor ring 50 is to minimize the cross-sectional area of the chamber 44 at its inlet end 46, thereby increasing the velocity of the airstream 47 for any given amount of applied suction. Because airstream velocity is highest near the point in which the dust particles are produced, the dust particles are redirected into the chamber 44 before there is any significant dispersion of the particles from the worksite. Further, because the dust particles are drawn away from the machine tool 12 into the separate chamber 44, detrimental contact between the dust particles and the machine tool parts other than the cutter is avoided.

Because the dust particles can be directed in practically any radial direction away from the cutter depending upon the positional relationship of the cutter 20 with respect to the workpiece 22, it is important that the high velocity airstream occurs all around the cutter. The invention achieves this result because the chamber 44 completely surrounds the sleeve. Therefore, regardless of the direction the dust particles are propelled away from the cutter 18 (such as shown by dotted arrow 42' in FIG. 2), they always cross the path of the airstream which redirects the particles into the chamber, as earlier described.

The size of the restrictor ring 50 can be varied to vary the size of the open part of the cross-sectional area of the inlet end of chamber 44 and the velocity of airstream 47 therethrough. The ability to vary air velocity is advantageous since the nature of the produced dust particles (i.e., size, quantity and velocity in which they are propelled from a workpiece) will vary depending upon the material composition of the workpiece and the power of the machining tool. Preferably, the area of the inlet end 46 of the chamber 44 is chosen (in relation to the vacuum source) such that the velocity of the airstream is just high enough to divert substantially all the dust particles into the chamber. If this area is made significantly smaller than is necessary to create this velocity, the overall volumetric flow of air into the apparatus will be reduced. This volumetric flow reduction is a result of energy losses (friction, etc.) that are known to occur any time a restriction is placed in the path of a fluid flowing through a closed conduit. As the amount of air flowing to the apparatus is reduced, the capacity of the airstream to intercept and carry the dust particles is correspondingly reduced. Furthermore, reductions in the amount of air passing through the apparatus may result in precipitation of the dust particles out of the airstream so that they collect along the sides of the ducts 48 before reaching the disposal site. Thus, it is desirable to maintain as much air flow as possible through the apparatus to minimize this precipitation. Accordingly, restrictor ring 50 is removably attached to sleeve 24 by suitable means so that various-sized restrictor rings can be interchanged to achieve the desirable airstream velocity just noted while maintaining maximum volumetric air flow for a given vacuum source for most effective removal of the particles. In the preferred embodiment the restrictor ring 50 is configured to snugly fit over the outer end 28 of the sleeve. Alternative attachment means such as threaded fasteners are also contemplated.

Figure 3:
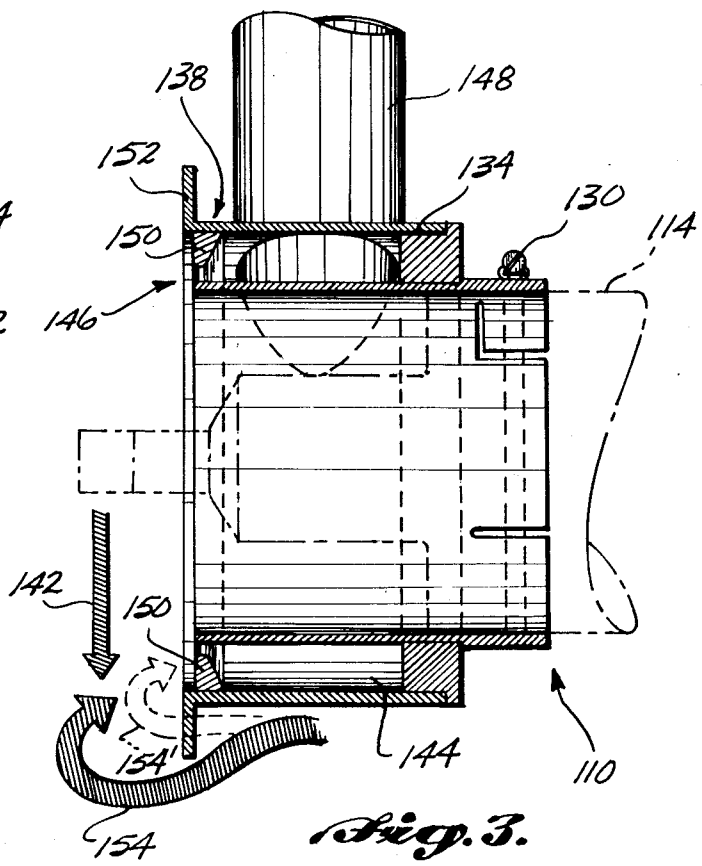
FIG. 3 is a cross-sectional view of an alternative embodiment of the dust collecting apparatus made in accordance with this invention illustrating the use of a flange to obstruct some of the airflow into the apparatus.

An alternative embodiment of an apparatus formed in accordance with this invention is shown in FIG. 3. Apparatus 110 of this embodiment is essentially the same as described with reference to FIGS. 1 and 2 except for two differences. Firstly, a radially outwardly projecting flange 152 is fixed to the outer end 138 of the shroud 134. The flange 152 alters the flow of air that is drawn into the chamber 144 so that nearly all of the drawn air will function to remove dust particles 142, rather than only a portion functioning in this manner. To this end, the flange 152 diverts the air 154 that is drawn from alongside the shroud 134 into a path around the flange that substantially crosses the path of the propelled dust particles 142. Absent the flange 152, the air drawn from alongside the shroud tends to pass into the chamber 144 without first crossing the path of dust particles 142 as depicted by dotted arrow 154'. As a result, this air does not remove dust particles, or is less than fully effective in this regard.

The embodiment illustrated in FIG. 3 also shows that the restrictor ring 150 can alternatively be positioned around the internal circumference of the shroud 134 to reduce the cross-sectional area of the inlet end 146 of the chamber.

Figure 4:
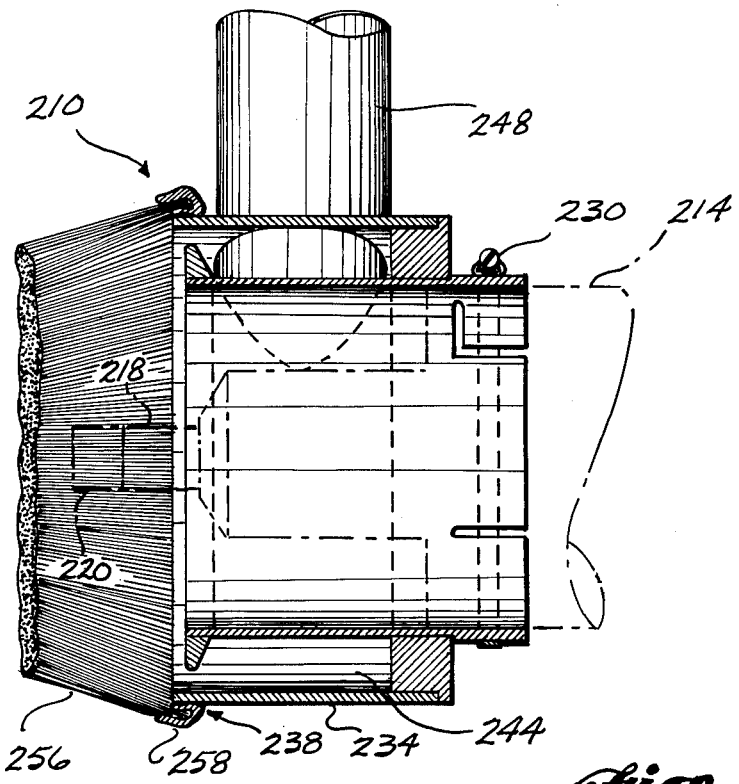
FIG. 4 is a cross-sectional view of another alternative embodiment of the dust collector apparatus made in accordance with this invention showing an attached barrier member surrounding the outermost end of the cutter.

As noted earlier, the amount of dust particles produced by the machine tool will vary depending upon the material being machined, the power of the tool and the force in which the tool is applied to the workpiece. Hence, in some situations, very large quantities of dust may be created and propelled with very high velocity away from the workpiece. In accordance with the invention, the collection of large quantities of dust particles is enhanced by attaching a physical barrier to the dust collecting apparatus that prevents dust particles from passing through the airstream and avoiding collection. In this regard, reference is made to FIG. 4 which shows such an embodiment of a dust collection apparatus 210 formed in accordance with this invention. This embodiment is substantially similar to the embodiment described with reference to FIGS. 1 and 2 except that a barrier element 256 has been affixed to the outer end 238 of the shroud 234 by a clamp 258.

In the preferred embodiment, the barrier element comprises a multitude of flexible bristles that extend outwardly from the outer end of the shroud 234 and completely surround the abrasive end 220 of the cutter 218. The clamp 258 is substantially "C"-shaped in cross section and extends completely around the circumference of the outer end 238 of shroud 234. The clamp 258 is fastened to the shroud 234 by any suitable means such as welding. The open end of the clamp holds one end of the barrier element 256. Dust particles that are propelled with such momentum that they would otherwise pass by the inlet end of the chamber 244 impinge upon the bristles and are subsequently drawn into the chamber.

Figure 5:
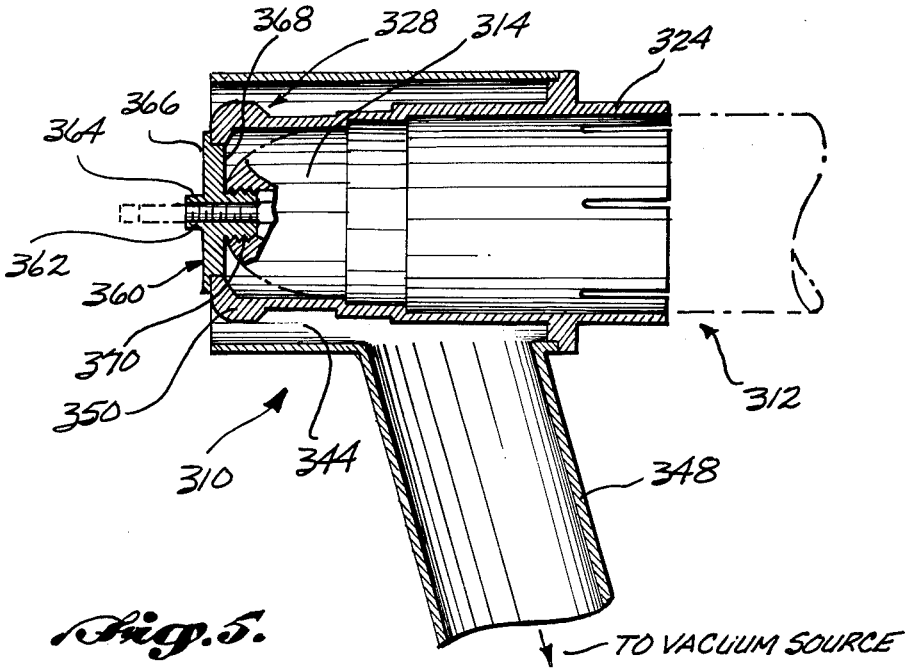
FIG. 5 is a cross-sectional view of a dust collector apparatus made in accordance with this invention attached to a hand-held machining tool.

A dust collection apparatus formed in accordance with this invention is readily adaptable to a wide variety of rotary-type machine tools. FIG. 5 illustrates the apparatus 310 attached to a conventional hand-held router 312. In this embodiment the sleeve 324 is formed with a stepped bore configured to fit the exterior shape of the router 312 when the router is inserted within the sleeve. The restrictor 350 in this embodiment is integrally formed in the outer end 328 of the sleeve 324. It is to be understood that a removably attached restrictor ring could also be employed in this embodiment.

A disk-shaped cap 360 fits over the opening in the outer end 238 of the sleeve 324. The cap 360 abuts the outermost end of the sleeve 324 and has opposing flat sides 366 and 368, one side 368 facing the router 312. A hollow sleeve 364 is integrally formed in the center of the cap 360 and protrudes perpendicularly from each of the opposing flat sides 366 and 368, respectively. The portion of the sleeve 364 that protrudes from the side of the cap 368 facing the router is threaded around its periphery to engage a correspondingly threaded aperture 370 formed in the nonrotatable body 314 of router 312. When the threaded portion of the sleeve 364 is threaded into the body of the router 312 the router is prevented from moving out of the bore of the sleeve 324. Furthermore, cap 360 prevents dust particles from being drawn into the bore of the sleeve 324 instead of into chamber 344. Dust particles drawn into the chamber 344 are disposed of via the tube 348 connected to the vacuum source.

While the present invention has been described in relation to preferred embodiments, it is understood that various alterations, substitutions of equivalents and other changes can be made without departing from the spirit and scope of the invention.

The embodiments of the invention in which an exclusive property or privilege is claimed are defined as follows:

1. A dust collection apparatus for a machine tool that includes a body, a rotatable spindle mounted at one end to the body and projecting therefrom, and a cutter attached to the other end of the spindle, said dust collection apparatus comprising:

(a) a hollow sleeve having an inner end and an outer end, the inner end of the sleeve sized to fit over and be attached to the body of the machine tool so that the cutter projects outwardly through the outer end of the sleeve;

(b) a hollow shroud connected to the sleeve and having a cross-sectional area greater than the sleeve, the shroud being positioned to substantially surround the sleeve, the shroud having an inner end and an outer end corresponding to the inner end and the outer end, respectively, of the sleeve, the shroud being configured and arranged to define a chamber between the sleeve and shroud, the chamber extending substantially around the periphery of the sleeve, the chamber having an open inlet end defined by the space between the outer end of the sleeve and the outer end of the shroud;

(c) an outwardly projecting flange attached to the outer end of the shroud;

(d) suction means connected to the shroud for creating a vacuum in the chamber defined between said sleeve and the shroud; and (e) restriction means operatively associated with the inlet end of the chamber for minimizing the cross-sectional area of the chamber at the inlet end.

2. The dust collection apparatus of claim 1 further including a barrier member affixed to the outer end of the shroud and extending outwardly to substantially surround the outermost end of the cutter.

3. The dust collection apparatus of claim 1 wherein the sleeve and shroud are substantially cylindrically shaped and wherein the restriction means is a ring removably attached around the circumference of the outer end of the sleeve.

4. The dust collection apparatus of claim 1 wherein the sleeve and shroud are substantially cylindrically shaped and wherein the restriction means is a ring that is removably attached around the circumference of the shroud at the outer end thereof.

5. The dust collection apparatus of claim 1 wherein the restriction means is an annular protrusion integrally formed in the sleeve at the outer end thereof.

6. The dust collection apparatus of claim 1 wherein the restriction means is an annular protrusion integrally formed in the shroud at the outer end thereof.

7. The dust collection apparatus of claim 2 wherein the sleeve and shroud are substantially cylindrically shaped and wherein the restriction means is a ring removably attached around the circumference of the outer end of the sleeve.

8. The dust collection apparatus of claim 2 wherein the sleeve and shroud are substantially cylindrically shaped and wherein the restriction means is a ring that is removably attached around the circumference of the shroud at the outer end thereof.

9. The dust collection apparatus of claim 2 wherein the restriction means is an annular protrusion integrally formed in the sleeve at the outer end thereof.

10. The dust collection apparatus of claim 2 wherein the restriction means is an annular protrusion integrally formed in the shroud at the outer end thereof.

11. A dust collection apparatus for a machine tool that includes a body, a rotatable spindle mounted at one end to the body and projecting therefrom, and a cutter attached to the other end of the spindle, said dust collection apparatus comprising:

(a) a hollow cylindrical sleeve having an inner end and an outer end, the inner end of the sleeve sized to fit over and be attached to the body of the machine tool so that the cutter projects outwardly through the outer end of the sleeve;

(b) a hollow cylindrical shroud connected to the sleeve and having a cross-sectional area greater than the sleeve, the shroud being positioned to substantially surround the sleeve, the shroud having an inner end and an outer end corresponding to the inner end and the outer end, respectively, of the sleeve, the shroud being configured and arranged to define a chamber between the sleeve and shroud, the chamber extending substantially around the periphery of the sleeve, the chamber having an open inlet end defined by the space between the outer end of the sleeve and the outer end of the shroud;

(c) suction means connected to the shroud for creating a vacuum in the chamber defined between said sleeve and the shroud; and (d) restriction means operatively associated with the inlet end of the chamber for minimizing the cross-sectional area of the chamber at the inlet end, the restriction means comprising a ring removably attached around the circumference of the outer end of the sleeve.

12. A dust collection apparatus for a machine tool that includes a body, a rotatable spindle mounted at one end to the body and projecting therefrom, and a cutter attached to the other end of the spindle, said dust collection apparatus comprising:

(a) a hollow cylindrical sleeve having an inner end and an outer end, the inner end of the sleeve sized to fit over and be attached to the body of the machine tool so that the cutter projects outwardly through the outer end of the sleeve;

(b) a hollow cylindrical shroud connected to the sleeve and having a cross-sectional area greater than the sleeve, the shroud being positioned to substantially surround the sleeve, the shroud having an inner end and an outer end corresponding to the inner end and the outer end, respectively, of the sleeve, the shroud being configured and arranged to define a chamber between the sleeve and shroud, the chamber extending substantialy around the periphery of the sleeve, the chamber having an open inlet end defined by the space between the outer end of the sleeve and the outer end of the shroud;

(c) suction means connected to the shroud for creating a vacuum in the chamber defined between said sleeve and the shroud; and (d) restriction means operatively associated with the inlet end of the chamber for minimizing the cross-sectional area of the chamber at the inlet end, the restriction means comprising a ring that is removably attached around the circumference of the shroud at the outer end thereof.

* * * * *